US007086310B2

(12) United States Patent
Oleksy

(10) Patent No.: US 7,086,310 B2
(45) Date of Patent: Aug. 8, 2006

(54) NON-SLIP BOTTLE OPENER

(76) Inventor: John R. Oleksy, 19 Demarco Rd., Sudbury, MA (US) 01776

( * ) Notice: Subject to any disclaimer, the term of this patent is extended or adjusted under 35 U.S.C. 154(b) by 0 days.

(21) Appl. No.: 11/015,589

(22) Filed: Dec. 17, 2004

(65) Prior Publication Data

US 2006/0130613 A1 Jun. 22, 2006

(51) Int. Cl.
*B67B 7/16* (2006.01)

(52) U.S. Cl. ..... 81/3.57; 81/3.4; 81/3.08

(58) Field of Classification Search ..... 81/3.57, 81/3.4–3.42, 3.07, 3.08, 3.09, 3.15, 3.29, 81/3.35–3.37
See application file for complete search history.

(56) References Cited

U.S. PATENT DOCUMENTS

| | | | | | |
|---|---|---|---|---|---|
| 1,199,272 | A | | 9/1916 | Hutter | |
| 1,299,974 | A | * | 4/1919 | Lorenz et al. | 215/270 |
| 1,307,519 | A | | 6/1919 | Scarborough | |
| 1,314,905 | A | | 9/1919 | Sard | |
| 1,507,093 | A | | 9/1924 | Schioniger | |
| 1,652,201 | A | * | 12/1927 | Harris | 76/101.1 |
| D89,924 | S | | 5/1933 | Schnoor | |
| 1,913,816 | A | * | 6/1933 | Osborne | 81/3.57 |
| 2,018,083 | A | * | 10/1935 | Murdock | 81/3.57 |
| 2,106,639 | A | | 1/1938 | Jenkinson | |
| D112,355 | S | | 11/1938 | Acker | |
| D118,329 | S | | 12/1939 | Crowley | |
| 2,525,693 | A | | 10/1950 | Levy | |
| 2,564,257 | A | | 3/1951 | Eckman | |
| 2,621,550 | A | * | 12/1952 | Bach | 81/3.57 |
| 2,716,277 | A | | 8/1955 | Riley | |
| 2,733,505 | A | | 2/1956 | Kenington et al. | |
| 4,409,864 | A | | 10/1983 | Gaskins | |
| 4,433,597 | A | | 2/1984 | Rowland | |
| 4,617,842 | A | * | 10/1986 | Yang | 81/3.09 |
| 4,949,600 | A | | 8/1990 | Tricnella | |
| 4,976,172 | A | | 12/1990 | Thomas et al. | |
| 5,189,750 | A | | 3/1993 | Brennan | |
| 5,267,494 | A | * | 12/1993 | Waluda | 81/3.09 |
| D356,237 | S | * | 3/1995 | White | D8/34 |
| 5,920,935 | A | * | 7/1999 | Beck | 7/128 |
| 6,220,118 | B1 | * | 4/2001 | Pacheco et al. | 81/3.55 |
| 6,755,867 | B1 | * | 6/2004 | Rousseau | 623/23.64 |

* cited by examiner

*Primary Examiner*—Lee D. Wilson
*Assistant Examiner*—Alvin J. Grant
(74) *Attorney, Agent, or Firm*—Edward L. Kelley; Invention Management Associates

(57) ABSTRACT

A non slip bottle cap opener (100) for installing onto a key ring or key chain with other keys is formed with the approximate length and thickness of a standard key to allow it to be comfortably carried on the key ring or chain like an ordinary key. The opener includes a pry element (120) formed with a narrow leading edge (140) for installing within the annular gap (60) between the bottle cap and the bottle top. The pry element further includes an engaging surface (165) that acts upon an inside surface of the annular lip of the bottle cap to forcibly engaged with the annular lip to prevent the opener from slipping off of the bottle cap.

18 Claims, 7 Drawing Sheets

NON-SLIP BOTTLE OPENER

BACKGROUND OR THE INVENTION

1. Field of the Invention

The invention relates to bottle cap removers or bottle openers and specifically provides a non-slip bottle cap remover for fitting compactly on a key ring with standard keys. In particular the portable bottle cap remover of the present invention provides pry handle and bottle cap removing nose section of thin cross-section for fitting between keys on a key ring as well as an overall length approximately equal to the length of standards keys. In addition, the nose portion includes a pry element that fits within a gap between a bottle top and a bottle cap and a fulcrum element shaped to vary a bottle cap removing pry force over its range of motion.

2. Description of Related Art

Portable bottle cap removing tools or bottle openers are widely known and used to remove malleable bottle caps from beverage bottles and the like. Malleable bottle caps, usually metal, are generally crimped or otherwise formed over the top of a glass bottle to form a gas/liquid seal with the bottle top. In general, metal bottle caps are not removable by hand and require a bottle cap removing tool for prying the cap from the bottle. The removal tool generally allows a user to pry the bottle cap from the bottle top using a hand applied force that is easily applied by the average user. The prying force applied by the removal tool deforms the bottle cap so that it first breaks the seal between the bottle cap and the bottle top and thereafter continues to apply a force to the bottle cap until it becomes completely dislodged from the bottle.

FIG. 1 depicts the configuration of a typical glass beverage bottle top 10 shown in section view. As shown, the bottle top 10 is formed with a circular opening 15 surrounded by an annular rim 20. The annular rim 20 is specifically provided to receive a bottle cap thereon and to form a liquid/gas tight seal with a bottle cap. The rim 20 includes a flat annular top surface 25, surrounding the bottle circular opening 15. The cross-section of the annular rim 20 includes a maximum outside diameter 30 and the bottle top necks down to a local minimum diameter 35 before increasing in cross-section.

FIG. 2 depicts a section view taken through the bottle top 10 and a metal bottle cap 40 installed thereon. As shown, the bottle cap 40 includes a thin circular flat disk shaped top section 45 and an annular lip section 50 extending downwardly therefrom. The inside surface of the flat top section 45 mates with the flat annular top surface 25 of the bottle top to seal the bottle opening 15. The bottle cap annular lip section 50 is crimped over the bottle rim maximum outside diameter 30 and tightly held thereto. As shown in FIG. 2, there is an annular gap 60 formed between an inner diameter of the bottle cap annular rim 50 and the region of the bottle top minimum diameter 35. As is well known, most bottle caps are formed with annular lip section 50 having a scalloped lower edge 55. The scalloping results from the forming process used to shape the bottle cap. As a result of the scalloping the annular gap 60 is not uniform in width but has a width that varies slightly at alternating peaks and valleys of the scalloped edge 55.

In general, bottle cap removers include one or more prying elements that are placed into contact with the lower edge 55, one or more fulcrum elements that are placed into contact with the outside surface of the bottle cap flat top section 45, and a handle element, connecting the prying and fulcrum elements to provide a lever point distal from the fulcrum elements. The lever point provides a mechanical advantage such that a force applied at the distal lever point rotates the bottle cap removing tool causing the prying elements to rotate about a contact point between the fulcrum element and the outside surface of the bottle cap top section 45. As the handle is rotated by the user, the prying elements grip the lower edge 55, and as more force is applied to the handle, the prying elements deform the bottle cap lip 50 to initially break its seal with the bottle and thereafter may further deform the bottle cap lip and the bottle cap top section by continuing to apply a prying force until the bottle cap is free of the bottle rim maximum outside diameter 30. Ideally, the force applied to the handle is generally within the range that can be easily hand applied by a user.

One problem with the portable bottle cap removers of the prior art is that there is a tendency of the prying elements to slip off the lower edge 55. Conventional bottle cap openers are especially susceptible to slipping as the shape of the annular lip section 50 is deformed by the prying force. In particular, it is a common problem with conventional bottle cap removing tools that they slip off the edge 55 before the bottle cap has been sufficiently deformed to remove it. After the tool has slipped off, it is customary for a user to slightly rotate the tool, or the bottle, to reposition the prying elements at a new, undeformed, location on the bottle cap lip section 55 and reapply the prying force to pry another section of the lip 50 away from the bottle. This process may be repeated two or three times before the bottle cap is completely removed. Amazingly, this has been an acceptable practice for a very long time. While many bottle cap openers have solved the problem of slipping by providing spaced apart prying elements that contact the edge 55 at two or more angularly spaced apart points, these devices do not have a thin cross-section and therefore do not fit compactly onto key ring or chain with keys.

Accordingly, there is still a need in the art for a portable bottle cap removing tool that compactly attaches to a key ring or chain, with keys, and that provides non-slip bottle cap removal. One example of a key ring or chain mountable bottle opener is shown in U.S. Pat. No. 4,949,600 by Tricenalla. Tricenalla teaches a bottle cap opening tool with a cross-section that compactly attaches to a key ring or chain with keys, however, not as compactly as the bottle opener of the present invention. Specifically, Tricenalle describes the problem that compact bottle openers made from untreated steel are subject to rusting and that bottle openers made from extruded aluminum are damaged by wear and abrasion of the pry surfaces that contact the bottle cap edge 55. To solve these problems Tricenalle teaches a two piece bottle cap opener having a first piece comprising a unitary handle and a fulcrum element formed from a stiff moldable polymeric material, and second piece comprising a metal pry element formed from a wear resistant metal edge gripper plate attached to the unitary handle and fulcrum element. In particular, Tricenalle suggests that the edge gripper plate be formed from wear and rust resistant stainless steel. In addition, the metal edge gripper plate of Tricenalle is shown with an arcate surface matching the radius of a bottle top for better contact with the lower edge 55, and with a tongue notched in the edge gripper plate to allow a front edge of the edge gripper plate to be positioned closely adjacent to the bottle neck. While the bottle cap removing tool taught by Tricenalle readily attaches to a key chain and provides improved gripping and wear resistance, it has the undesirable properties that the molded unitary handle/fulcrum element may require costly mold tooling to manufacture and that the final opener which includes the handle and the edge gripper plate, must be assembled and this adds labor cost to the manufacturing cost of the opener. Another problem with the disclosure of Ticenalle is that the cross-section or thickness, while not specifically given, appears to be much thicker than the cross section of a standard key. In addition, there is no indication given by Tricenalle that the gripper plate fits within the gap 60 and therefore the opener proposed by Tricenalle may also slip off of the lower edge 55 after the initial deformation.

In another example of a bottle cap removing tool for attaching to a key ring, or chain, U.S. Pat. No. 5,267,494 by Waluda discloses a bottle opening cut-out formed in a functional key. According to Waluda, a key includes a head portion, which is held by the user, and a body portion, which is inserted into a lock. Waluda discloses a U-shaped cut out formed in the key head is usable to remove a bottle cap from a bottle, and suggests that a brass or aluminum key will open bottle caps without breaking the key. Moreover, Waluda teaches that a key having an average body length in the range of 28.5–44.5 mm, (1 ⅛–1¾ inches), provides sufficient leverage to remove a bottle cap using the U-shaped cutout. Other examples of keys combined with bottle cap opening elements are also disclosed in U.S. Pat. No. 1,314,905 by Sard and Des. 89,924 by Schnoor. While these examples of keys that are usable as bottle openers are convenient, there is a problem with the examples because keys are often made of a soft metal, so they can be easily reproduced, and the soft metal key material is readily worn and abraded by a bottle cap. Moreover, the U-shaped cutouts disclosed by Waluda need to be accepted by the key manufacturer and are most economically cut into the key blanks at the time of manufacture. In addition, the U-shaped cutout disclosed by Waluda does not appear to solve the problem that the lifting or prying edge slips off the bottle cap lower edge 55 as soon as the cap begins to be deformed such that two or three prying steps may be need to remove the bottle cap.

BRIEF SUMMARY OF THE INVENTION

The present invention overcomes the problems cited in the prior by providing a non-slip compact bottle cap opener 100 for removing a bottle cap 40 from a bottle top 10. The opener 100 is formed as a unitary element with its length and thickness similar to length and thickness of a standard key so that it can fit comfortably onto a key ring or key chain with other keys. The opener 100 has a handle portion 105 with which the user applies prying force to the bottle cap with a mechanical advantage. The handle includes a through hole or other attaching arrangement for attaching the opener to a key ring or chain. A nose portion 110 is formed unitary with the handled portion and is shaped to engage with the bottle cap. The nose portion includes a pry element 120 that is formed with a narrow leading edge 140 for installing within an annular gap 60 between the bottle cap and the bottle top. The pry element provides an engaging surface 165 that engages with and acts upon an inside surface of a bottle cap annular lip section 50 to deform the bottle cap and remove it from the bottle when a user applies a rotation force to the handle portion. To facilitate easy removal and to prevent the bottle cap from tearing, the bottle cap opener nose portion is formed with two distinct fulcrum edges for contacting the top surface of the bottle cap. Each fulcrum edge provides a pivot edge about which the bottle opener pivots as it is rotated to remove the bottle cap. While in the preferred embodiment of the invention fulcrum edge surfaces are described, each fulcrum edge may also comprise a radius or a small area such as a round or rectangular surface positioned to contact the bottle top as detailed in the detailed description of the invention. A first fulcrum edge 135, is formed opposed to the pry element 120, and contacts the bottle cap top section 45 at a first position. The opener 100 initially pivots about the first fulcrum edge 135 as the pry element deforms the bottle cap at an annular lip section 50. A first force pry force $F_1$ is generated at the pry element 120 as the opener 100 rotates about the first fulcrum edge. A second fulcrum edge 160 is formed opposed to the pry element 120 and contacts the bottle cap top section 45 at a second position. The opener 100 pivots about the second fulcrum edge 160 after it has rotated about 18 degrees from its starting position. A second pry force $F_2$, is generated at the pry element 120 as the opener 100 rotates about the second fulcrum edge 160 and the second pry force is less than the first pry force. The lower second pry force helps to prevent the opener 100 from further deforming the bottle cap lip section and slipping off of the bottle cap before it has been removed.

The bottle opener 100 is formed with a length of about 50–80 mm, (1.97–3.15 inches) and a thickness of about 1.5–5 mm, (0.06–0.2 inches) so as to comfortably fit onto a key ring with keys. The preferred material is corrosion resistant and resilient so the opener may be formed from a titanium alloy, stainless steel or an aluminum alloys and preferably from an alloy having a Brinell hardness of at least 150. In addition, the preferred construct of the opener 100 is a unitary element cut from sheet stock but other embodiments and manufacturing methods are suitable without deviating from the present invention.

BRIEF DESCRIPTION OF THE DRAWINGS

The features of the present invention will best be understood from a detailed description of the invention and a preferred embodiment thereof selected for the purposes of illustration and shown in the accompanying drawing in which:

FIG. 11 illustrates a nesting arrangement used to economically cut the bottle opener according to the present invention from sheet stock.

DETAILED DESCRIPTION OF THE INVENTION

Figure 5:
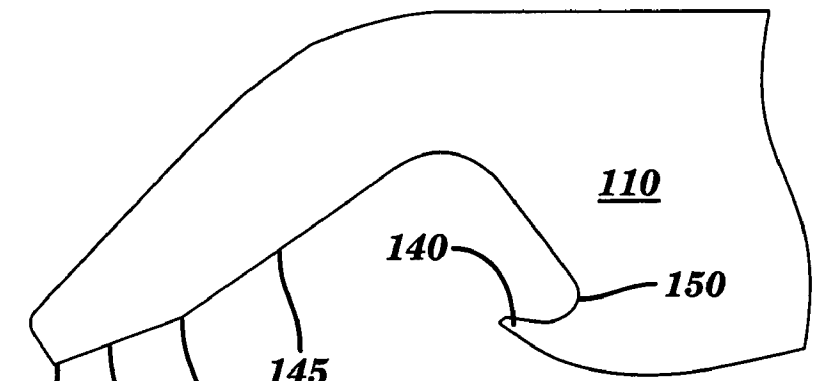
FIG. 5 illustrates an exploded side view of the nose portion of the bottle cap opener according to the present invention.
Figure 9:
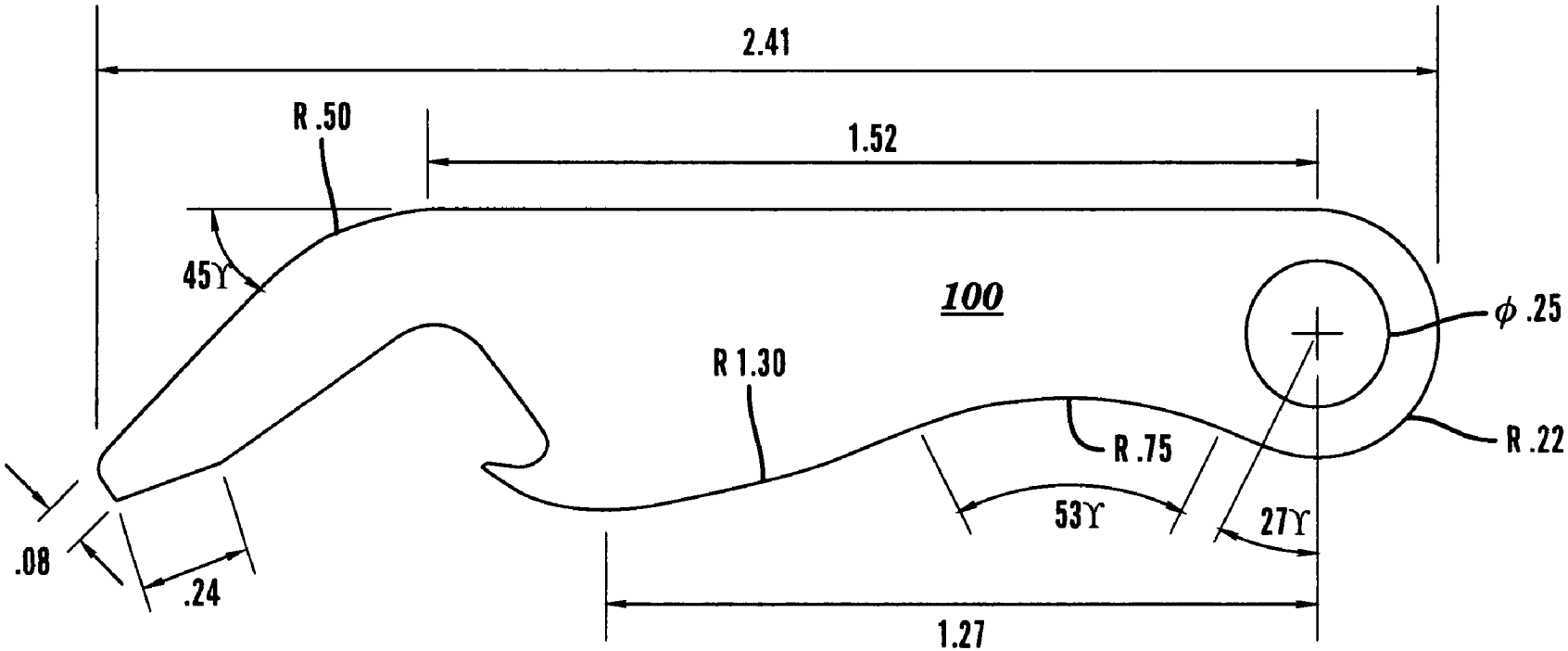
FIG. 9 illustrates a side view of the bottle opener according to the present invention with preferred dimensions for locating the fulcrum edges shown in millimeters.
Figure 10:
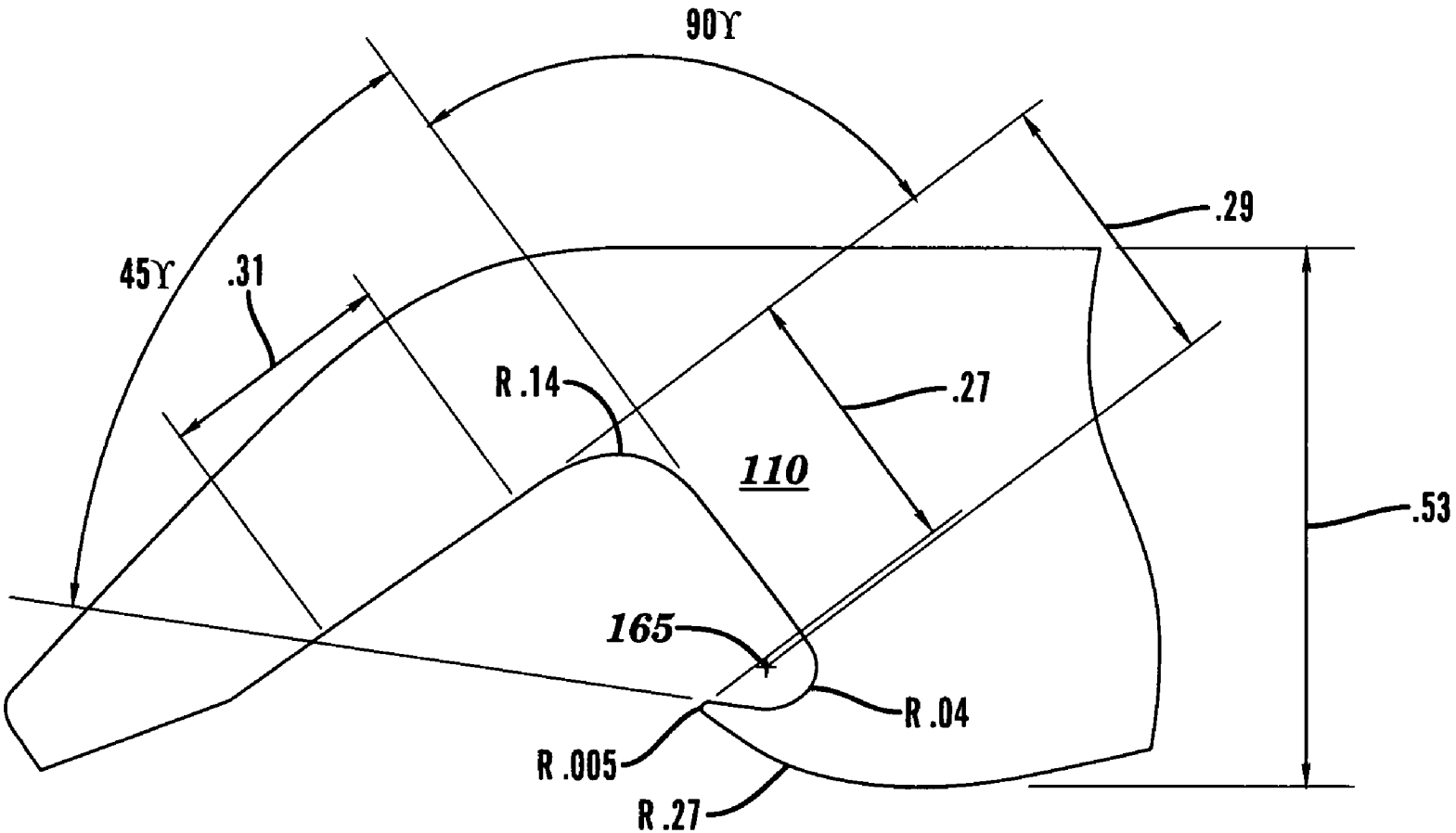
FIG. 10 illustrates an exploded side view of the nose portion of the bottle opener according to the present invention with preferred dimensions for locating the pry element shown in millimeters.

FIGS. 3–6 and 9–10 depict an improved bottle cap opener 100 according to the present invention. The opener 100 is shown in side view in FIGS. 3 and 9 and in isometric view in FIG. 4. An exploded view of a nose portion of the opener is shown in FIGS. 5 and 10. The opener 100 may be formed with a uniform thickness in the range of about 1.5–5.0 mm, (0.06–0.2 inches) but the preferred thickness is 2.3 mm, (0.09 inches). Ideally, the bottle cap opener 100 is formed from a metal having a hardness that is harder that the hardness of a conventional bottle cap so that the opener 100 will not be worn down by long term use. Accordingly, the opener 100 may be formed from a material having a Brinell Hardness above 200 to provide excellent wear resistant properties however, the opener 100 may also be formed of softer materials with a Brinell Hardness above 150 being acceptable.

Preferably the bottle cap opener 100 is formed from a corrosion resistant metal or from a metal that is surface treated to prevent corrosion. In addition, a material available in flat stock is preferred so that the opener 100 may cut directly from the flat stock having a thickness matching the desired thickness of the opener. In particular a preferred material is a 6AL-4V titanium alloy which is available in sheet stock in the desired thickness range, has a Brinell Hardness above 300, has a high strength to weight ratio, and is corrosion resistant. In addition, corrosion resistant stainless steels as well as some aluminum alloys are also suitable for forming the opener 100.

The bottle cap opener 100 may be formed using one of many conventional metal forming processes but the opener 100 is preferably formed by stamping, also called die cutting, or by water jet or laser cutting the finished openers from a flat sheet of metal stock or from a stack of flat sheets of metal stock placed one above another. In a further aspect of the invention, the opener 100 is shaped for nesting on the sheet stock to reduce the cutting time and material waste. An example is shown in FIG. 11. Alternately, openers may be formed by an electro-discharge machining (EDM) wire cutting process. In a preferred fabrication method, finished openers 100 are stamped or cut from a flat sheet of metal stock having the desired finish thickness and requiring no further heat or surface treatment to achieve the desired hardness and corrosion resistance properties.

Figure 3:
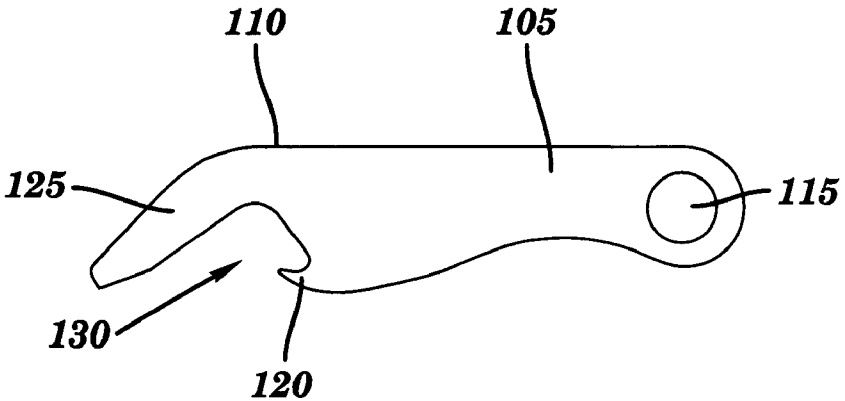
FIG. 3 illustrates a side view of an improved bottle cap opener according to the present invention.
Figure 4:
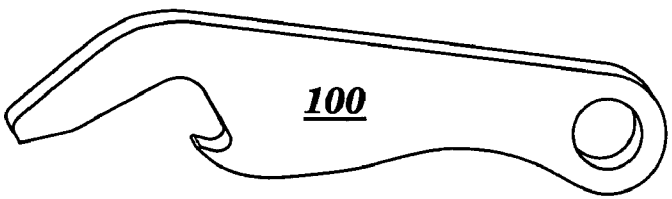
FIG. 4 illustrates an isometric view of an improved bottle cap opener according to the present invention.

Referring now to FIGS. 3–5 the bottle opener 100 has an overall length of 61.2 mm, (2.41 inches), which is about the same length as a standard key, and which is considerably shorter and more compact than most conventional bottle openers. As shown in FIG. 4 the opener 100 has a uniform thickness which is preferably 2.3 mm, (0.09 inches). This thickness is only slightly thicker than the thickness of a standard key. The opener 100 has a handle portion 105 for providing a lever arm that provides a mechanical advantage for prying the bottle cap from the bottle. A nose portion 110 is unitary with the handle portion 105 and is provided to interface with the bottle cap 40 and to deform the bottle cap 40 for removal from the bottle top 10. The handle portion 105 may include a hole 115 passing therethrough for attaching the opener 100 to a ring, or the like, such as a key ring or key chain, and since the opener 100 has approximately the same length and thickness as a standard key it fits easily onto a key ring or key chain like any other key without making the key ring uncomfortable to carry in a pocket. Thus the bottle opener 100 of the present invention provides a compact key ring mounted bottle opener that does not significantly change the size and shape of the key ring or chain carried by the user. In addition, the key ring or chain as well as the opener handle 105 may be gripped by the user when removing a bottle top for improved leverage and handling.

Figure 2:
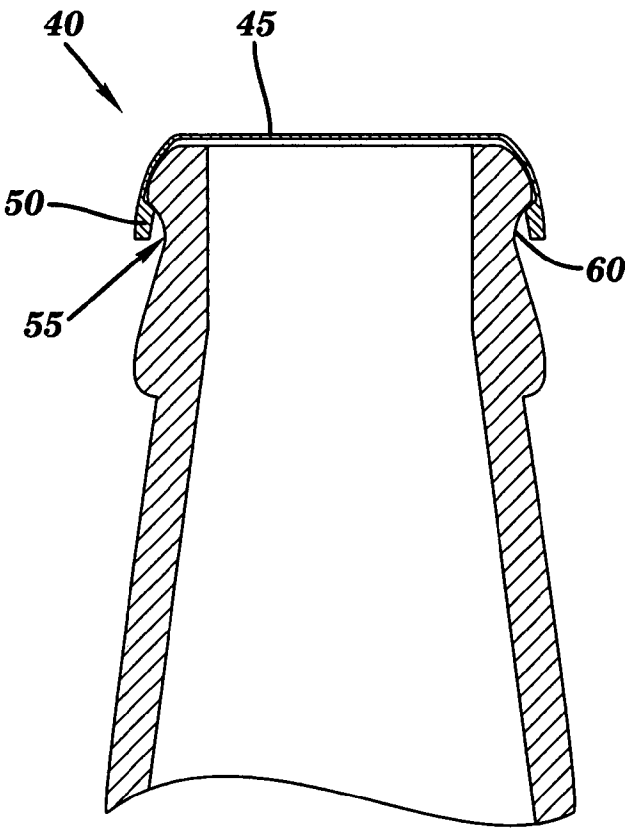
FIG. 2 illustrates the configuration of a typical bottle cap installed onto the glass beverage bottle top of FIG. 1, shown in section view.
Figure 1:
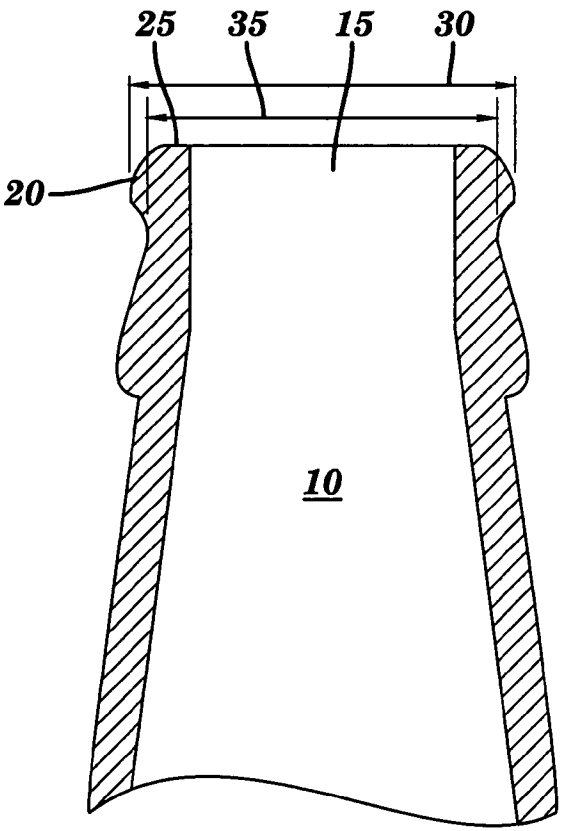
FIG. 1 illustrates the configuration of a typical glass beverage bottle top shown in section view.

Referring to FIGS. 3 and 5, the nose portion 110 includes a first portion shaped as a pry element 120 and a second portion shaped as a fulcrum element 125. In particular, the pry element 120 is formed with a narrow leading edge 140 that fits within the gap 60, (see FIG. 2). While conventional bottle cap openers engage the bottle cap with a pry element acting on the bottle cap lower edge 55, the pry element 120, of the present invention, specifically engages an inside edge of the annular lip 50 to prevent the bottle cap opener 100 from slipping off the bottle cap 40 as the cap is pried from the bottle top. The nose portion 110 is formed with opening 130 sized and shaped to fit snugly over a standard bottle cap when the pry element 120 is inserted within the gap 60 and the first fulcrum edge 135 is in contact with the bottle cap top. The design of the opener 100 is explained further below as its operation is detailed.

Figure 6:
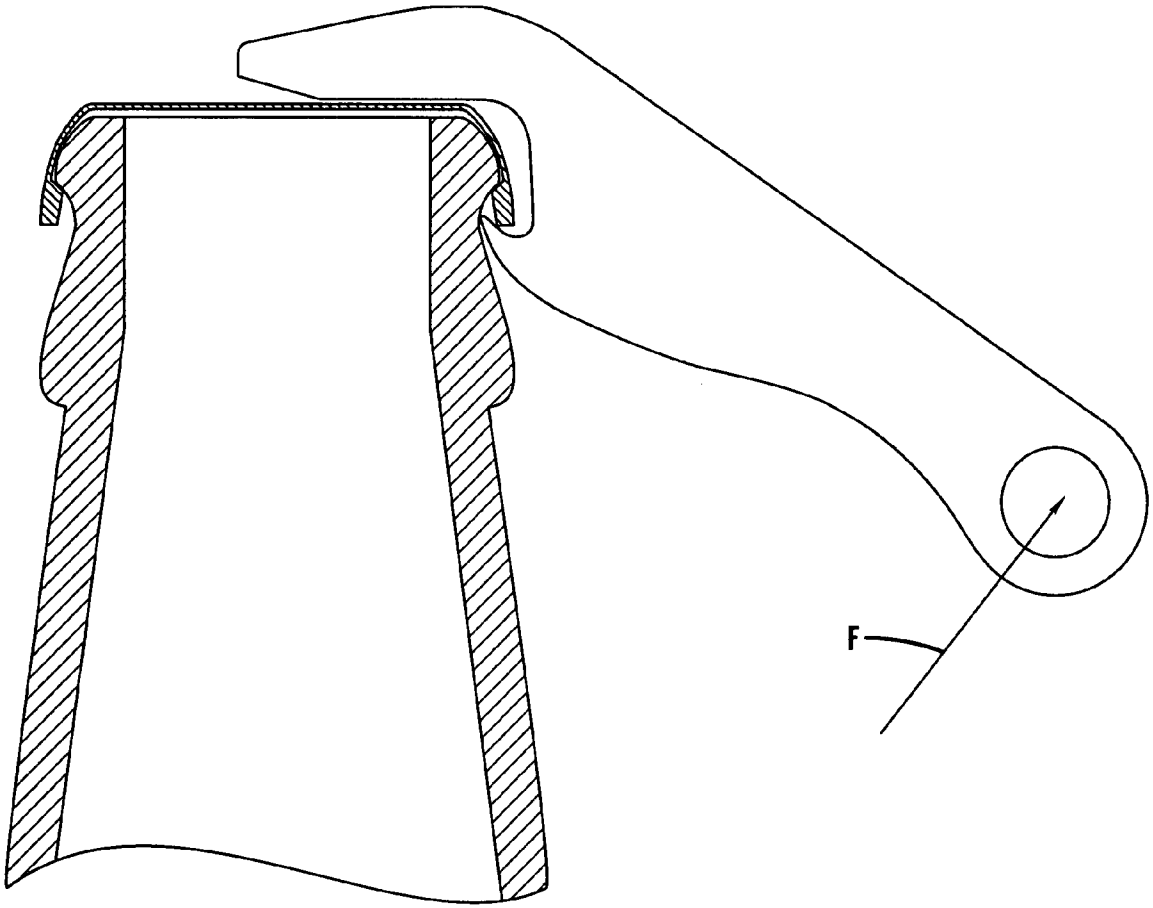
FIG. 6 illustrates a side view of a bottle top having the bottle cap opener according to the present invention positioned in a first start position.
Figure 7:
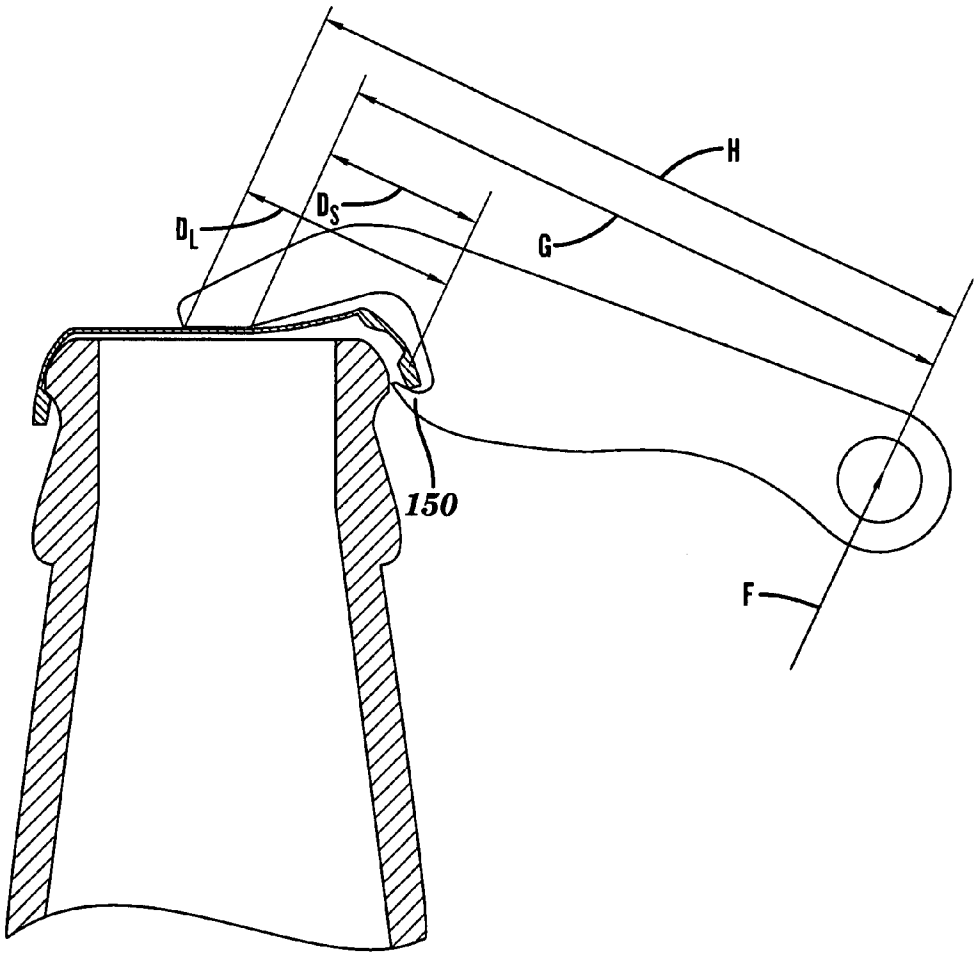
FIG. 7 illustrates a side view of a bottle top having the bottle cap opener according to the present invention positioned in a second seal breaking position and detailing the distances between the elements used to determine force ratios.
Figure 8:
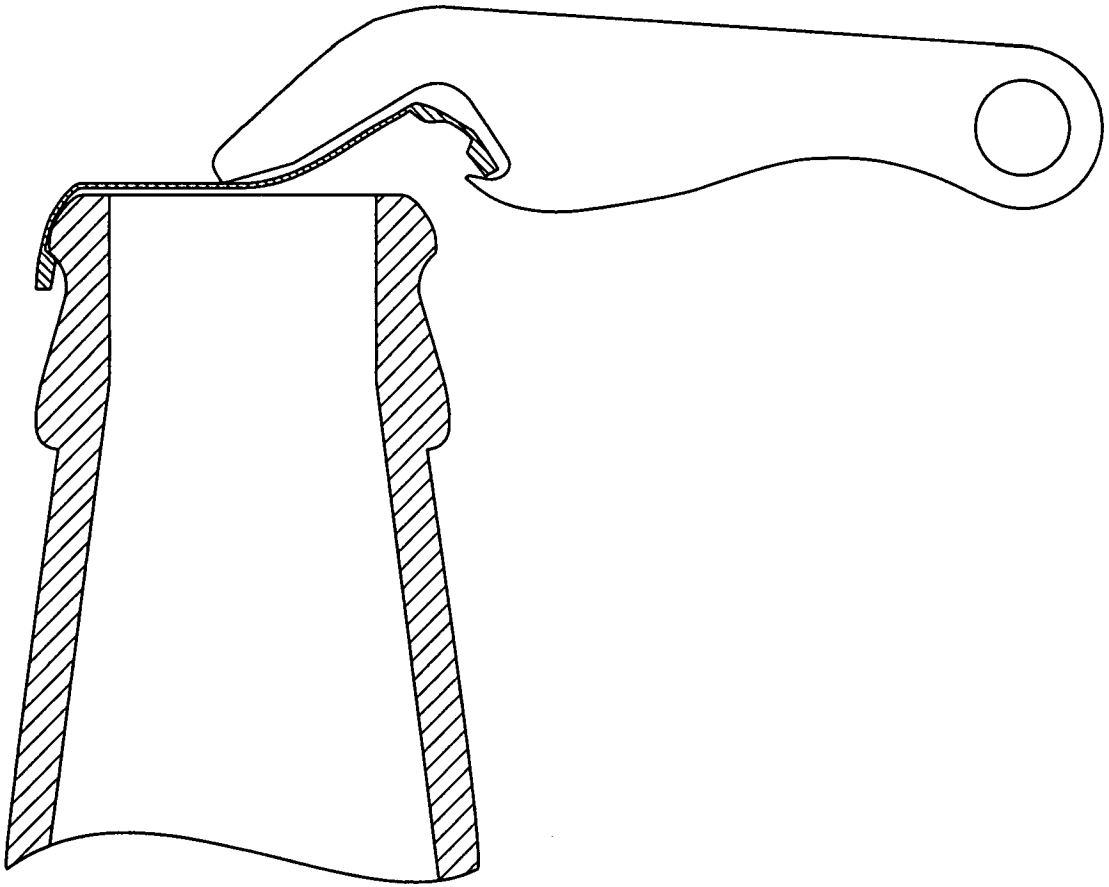
FIG. 8 illustrates a side view of a bottle top having the bottle cap opener according to the present invention positioned in a third bottle cap removing position.

Referring now to FIGS. 6–8 the operation of the improved bottle cap opener 100 for removing a bottle cap 40 without slipping off the bottle cap is demonstrated in three steps. In a first step, depicted in FIG. 6, the opener 100 is installed onto the bottle cap 40 in a first starting position. In the starting position the pry element 120 is installed within the gap 60 and securely engaged with an inner surface of the bottle cap annular rim section 50 and with the first fulcrum edge 135 in contact with the bottle cap disk shaped top section 45. The correct location of these elements is ensured by the size and relative position of the opening 130 with respect to the fulcrum elements 125 and the pry element 120 and a preferred interrelation of these elements is detailed in FIGS. 9 and 10. In particular, the pry element 120 is formed with a narrow leading edge 140, which is the edge that is inserted within the gap 60.

As further shown in FIGS. 5 and 6, the nose portion 110 includes a trailing surface 145 which is positioned and shaped to ensure that when the opener 100 is in the first starting position, a slight clearance is provided between the trailing surface 145 and the bottle cap top section 45. Thus according to one aspect of the present invention, when the opener 100 is in the first starting position it contacts the bottle cap at the first fulcrum edge 135 and at the pry element 120. With the bottle cap remover 100 in the first position, a user applies a rotation force approximately at the location and in the direction shown by the force vector F shown in FIG. 6. The force vector F acts on the first fulcrum edge 135 and on the pry element 120 and begins to deform the bottle cap annular lip section 50. In particular, the initial deformation of the bottle cap annular lip section is local to the contacting point of the pry element 120. The result of the applied force is to cause the pry element 120 to pull the annular lip section 50 radially away from the bottle top minimum outside diameter 35.

FIG. 7 depicts the opener 100 in a second, seal breaking, position. In the seal breaking position, the bottle cap 40 is shown deformed enough to expose the bottle top opening 15. Thus as the opener 100 is moved from the first staring position to the second seal breaking position it breaks the gas/liquid seal between the bottle cap and the bottle top. Also, as the opener 100 is rotated from the first staring position to the second seal breaking position, the bottle cap lower edge 55 is deformed by the pry element 120 and forced toward the center of a radius 150 formed at the base of the pry element 120. Thus according to one aspect of the present invention, the shape of the pry element 120 is formed with a contiguous radius 150 to forcibly engage the bottle cap annular lip section 50 with the radius 150 as the opener is moved from the first starting position toward the second seal breaking position. Thus according to the present invention, the force applied by the pry element 120 to the annular lip section 50 and the shape of the pry element 120 and radius 150 prevent the pry element from slipping off of the bottle cap.

As the bottle opener 100 moves from the first position to the second position it rotates about the first fulcrum edge 135. As shown in FIG. 7, the bottle opener nose portion 110 includes a leading surface 155 that is specifically formed at an angle of 18° with respect to the trailing surface 145. Thus as the opener 100 is rotated through approximately 18° from the starting position to the seal breaking position, the leading surface 155 becomes substantially parallel with the bottle cap disk shaped top section 45. Upon further rotation of the opener 100, the center of rotation begins to transfer from a rotation about the first fulcrum edge 135 to a rotation about a second fulcrum edge 160. Thus according to a further aspect of the present invention, the bottle opener 100 includes two distinctly separate fulcrum edges (135 and 160), each having a different radial distance, G and H, from the force vector F.

FIG. 8 depicts the opener 100 in a third, cap removing position. In the third cap removing position, the bottle cap 40 is shown deformed enough to become free of the bottle top maximum outside diameter 30 and completely removed from the bottle top. As shown in FIG. 8, in the third cap removing position, the second fulcrum edge 160 and the leading surface 155 are substantially in contact with the bottle cap top section 45 and the main deformation of the bottle cap has occurred in the section between the first fulcrum edge 135 and the pry element radius 150.

Referring again to FIG. 7, according to the present invention, the force vector F is applied at a distance G from the first fulcrum edge 135 as the opener 100 moves from the first starting position to the second seal breaking position. The force F acts on the first fulcrum edge 135 at a distance G and further acts on the pry element 120 with a force $F_1$ at a distance $D_S$. The force $F_1$ is given by $$F_1=G/D_S(F) \qquad \text{Equation 1}$$

As the opener 100 is further rotated past the second seal breaking position, the force vector F is applied at a distance H from the second fulcrum edge 160. The force F acts on the second fulcrum edge 160 at a distance H and further acts on the pry element 120 with a force $F_2$ at a distance $D_L$. The force $F_2$ is given by $$F_2=H/D_L(F) \qquad \text{Equation 2}$$

In the specific example of the present invention using the dimensions G=50 mm, $D_S$=14 mm, H=57 mm and $D_L$=20 mm, the force $F_1$=3.57 F and the force $F_2$=2.85 F. Thus according to a further aspect of the present invention, rotation about the first fulcrum edge 135 provides a greater mechanical advantage than rotation about the second fulcrum edge 160. In other words, a constant force F applied at the handle portion 105 applies a larger initial prying force $F_1$ as the opener 100 is rotated between the first starting position and the second seal breaking position and a smaller prying force $F_2$ as the opener is further rotated past the second seal breaking position. As a result, a high initial prying force is applied to initially pry a local region of the annular rim section 50 away from the bottle. The higher initial force $F_1$ serves to force the bottle cap lip 50 into the bottom of the radius 150 to provide a more positive grip of the bottle opener 100 with the bottle cap. In addition, the higher initial force $F_1$ produces a large initial deformation of the annular rim to pull it away from bottle top. Once the bottle cap has been sufficiently deformed by the initial force $F_1$, the smaller $F_2$ removes the bottle cap from the bottle top without much further deformation and this also prevents the bottle opener 100 from deforming the bottle cap so much that it slips or becomes disengaged with the lip 50 or so much that the bottle cap material tears.

Referring to FIGS. 9 and 10, the bottle cap opener 100 according to the present invention is shown with preferred detailed dimensions listed in millimeters and preferred angular orientations listed in degrees. The opener 100, as disclosed herein fits onto a standard bottle cap in a starting position, as depicted in FIG. 6 and removes a standard bottle cap in a swift hand motion without slipping off the bottle cap. Moreover, the pry element 120 installs into the gap 60 and remains engaged therein without slipping off as the bottle opener rotates from the start position to the bottle opening position. As detailed in FIGS. 9 and 10 the nose portion 110 is oriented at substantially 45° with respect to a longitudinal surface of the handle portion 105 with the trailing surface 145 oriented at a 38° angle with respect to the handle longitudinal surface and with the leading surface 155 oriented at a 20° angle with respect to the handle longitudinal surface. As further shown in FIG. 10, a pry element engaging surface 165, that engages the inside surface of the bottle cap annular lip 50 is formed with an angle of substantially 135° with respect to the trailing surface 145. This provides a comfortable engaging angle for the start position and allows the engaging surface 165 to be easily inserted into the gap 60.

In testing of the opener 100 bottle caps were repeatedly removed on the first attempt without slipping or the need to reapply the opener in a new starting position. In addition, applicants examined bottle caps removed by the opener of the present invention and observed that the top section of a removed bottle cap was slightly and equally creased at the locations where the first and second fulcrum edges 135 and 160 make contact with the bottle cap. This observation supports the fact that both fulcrum edges are indeed used to remove the bottle cap as described above.

As will also be recognized by those skilled in the art, tearing of the bottle cap material can occur when the pry element is so thin that the pry force is very highly concentrated over a small contact area. To avoid tearing, the pry force is applied over a longer length or surface area of the lip surface 55 and this helps to keep the material stress below a tearing stress. In many prior art devices, the prying force is distributed over multiple prying elements thereby applying a simultaneous prying force at a plurality of angularly spaced apart prying contact points along the bottle cap lower edge 55. However, it is desirable for the present invention to provide a bottle opener with a narrow thickness for fitting on a key ring with other keys. Applicants have found that a pry element thickness of about 2.28 mm, (0.09 inches), which is slightly thicker that an average key but not so thick that it becomes bulky when mounted on a key ring, is acceptable without tearing the bottle cap. As a further point of clarification, bottle caps are generally formed with the annular lip section 50 and its lower edge 55 scalloped. The scalloping results from the forming process used to shape the bottle cap. In addition, the scalloped edge serves to stiffen the annular lip section 50. As a result of the scalloping, the annular gap 60 does not have a uniform width but has a width modulated by the peaks and valleys of the scalloping. However, the dimension across each of the peaks of a standard bottle cap is less than about 1 mm, (0.04 inches) so that an opener 100 having a thickness of more than about 1.5 mm, (0.06 inches), spans across the peak dimension to generally contact the bottle cap inner surface at valley points no matter where it is installed within the gap 60. As further point, if the opener thickness is small enough to act within a peak dimension, i.e. without contacting valley points, the opener 100 will not be oriented at the desired starting position and the concentration of all of the prying force within the peak area may lead to tearing of the bottle cap material.

It will also be recognized by those skilled in the art that, while the invention has been described above in terms of preferred embodiments, it is not limited thereto. Various features and aspects of the above described invention may be used individually or jointly. Further, although the invention has been described in the context of its implementation in a particular environment, and for particular applications, e.g. for removing a bottle cap, those skilled in the art will recognize that its usefulness is not limited thereto and that the present invention can be beneficially utilized in any number of environments and implementations including but not limited to removing other types of bottle caps, including twist off bottle caps, or other pressed or crimped on food container caps such as jar caps. Accordingly, the claims set forth below should be construed in view of the full breadth and spirit of the invention as disclosed herein.

The invention claimed is:

1. A bottle cap opener (100) for removing a bottle cap (40) from a bottle top (10) comprising:

a unitary element having a length in the range of 50–80 mm (1.97–3.15 inches) and a substantially uniform thickness in the range of 1.5–5.0 mm, (0.6–0.20 inches) and further comprising;

a handle portion (105) having a longitudinal length disposed along a handle longitudinal axis for providing a mechanical advantage for prying the bottle cap from the bottle top when a constant force (F) is applied to a first end thereof; and, a nose portion (110) formed opposed to said first end for engaging with the bottle cap, said nose portion including, a pry element (120) for installing within an annular gap (60) between the bottle cap and the bottle top, a fulcrum element (125) for contacting the bottle cap at a top surface (45) thereof, and an opening (130) formed between the pry element (120) and the fulcrum element (125) said opening being sized and shaped to fit snugly over the bottle cap when the pry element is installed within the annular gap (60), and wherein said pry element includes an engaging surface (165) for acting upon an inside surface of a bottle cap annular lip section (50), said pry element being formed with a narrow leading edge (140) for installing within the gap (60) and with a radius (150) formed contiguous with the engaging surface (165) for forcibly engaging the bottle cap annular lip section (50) to prevent the pry element from slipping off of the bottle cap, and wherein said fulcrum element (125) includes a first fulcrum edge (135), formed at an intersection between a trailing surface (145) and a leading surface (155), and a second fulcrum edge (160), formed at an intersection between the leading surface (155) and another surface, and wherein said leading surface (155) is formed at an angle of substantially 18° with respect to said trailing surface (145).

2. The bottle cap opener of claim 1 wherein the handle portion includes a hole (115) passing therethrough for attaching the bottle cap opener (100) to one of a key ring and a key chain.

3. The bottle cap opener of claim 2:

wherein the nose portion is formed with the first fulcrum edge (135) positioned to contact the bottle cap top section (45) at a first position located at a first radial distance (G) from the force (F) being applied to the first end, and wherein the first position has a second radial distance ($D_S$) from the pry element (120) for deforming the annular lip section (50) with a first pry force ($F_1$) applied during rotation of the opener (100) about the first fulcrum edge (135); and, wherein the nose portion is formed with the second fulcrum edge (160) positioned to contact the bottle cap top section at a second position after said first 18 degrees of rotation of the opener (100), said second position being located at a third radial distance (H) from the force (F) applied to the first end, and wherein the second position has a fourth radial distance ($D_L$) from the pry element (120) for removing the bottle cap from the bottle top with a second pry force ($F_2$) applied during rotation of the opener (100) about the second fulcrum edge (160), and wherein said first radial distance (G) is less than said third radial distance (H), and said second radial distance ($D_S$) is less than said fourth radial distance ($D_L$) such that said second pry force ($F_2$) is less than said first pry force ($F_1$).

4. The bottle cap opener of claim 3 wherein said first radial distance (G) is substantially 50 mm, (1.97 inches), the second radial distance ($D_S$) is substantially 14.0 mm, (0.55 inches), the third radial distance (H) is substantially 57.0 mm, (2.24 inches) and the fourth radial distance ($D_L$) is substantially 20.0 mm, (0.79 inches) to thereby convert the constant force (F) applied to the first end to the force ($F_1$) equal to 3.57 times the force (F), during rotation of the bottle opener about the first fulcrum edge (135), and to the force ($F_2$) equal to 2.85 times the force (F), during rotation of the bottle opener about the second fulcrum edge (160).

5. The bottle cap opener of claim 2 wherein the unitary element is formed from a material having a Brinell hardness of at least 150.

6. The bottle cap opener of claim 5 wherein the unitary element is formed from one of a titanium alloy, a stainless steel alloy and an aluminum alloy.

7. The bottle cap opener of claim 1 wherein said thickness dimension is in the range of 1.5–3.0 mm, (0.06–0.12 inches).

8. The bottle cap opener of claim 1 wherein said overall length dimension is substantially 61 mm, (2.4 inches) and said thickness dimension is substantially 2.3 mm, (0.09 inches).

9. A bottle cap opener (100) for removing a bottle cap (40) from a bottle top (10), said bottle cap including an annular lip section (50) and a disk shaped top section (45), comprising:

a handle portion (105) forming a lever arm that provides a mechanical advantage for prying the bottle cap from the bottle top when a constant force (F) is applied to a first end thereof;

a nose portion (110), unitary with the handle portion and disposed at a second end thereof for providing an interface to the bottle cap (40) and for deforming the bottle cap for removal from the bottle top, said nose portion including a first portion shaped as a pry element (120), for engaging with an inside surface of the annular lip section (50), and a second portion shaped as a fulcrum element (125), for engaging with the disk shaped top section (45);

wherein the fulcrum element (125) includes a first fulcrum edge (135) disposed at a first radial distance (G) from the first end, and at a second radial distance $D_S$ from said pry element (120), for applying a first prying force ($F_1$) to said pry element (120) in response to the application of said constant force (F) to said first end and wherein said first force ($F_I$) is equal to the ratio $G/D_S$ times the constant force (F);

wherein the fulcrum element (125) further includes a second fulcrum edge (160) disposed at a second radial distance (H) from the first end and at a second radial distance ($D_L$) from said pry element (120), for applying a second prying force ($F_2$) to said pry element (120) in response to the application of said constant force (F) to said first end, said second force ($F_2$) is equal to the ratio $H/D_L$ times the constant force (F); and, wherein said nose portion (110) is configured to engage the disk shaped top section (45) with said first fulcrum edge (135) at a first position such that said first pry force ($F_1$) is applied to the pry element (120) during rotation of the opener (100) about the first fulcrum edge (135), for deforming the annular lip section (50), and to thereafter engage the disk shaped top section (45) with said second fulcrum edge (160), at a second position, such that said second pry force ($F_2$) is applied to the pry element (120) during rotation of the opener (100) about the second fulcrum edge (160) for removing the bottle cap from the bottle top.

10. The bottle cap opener of claim 9 wherein the pry element (120) comprises a narrow leading edge (140) for installing within an annular gap (60) between the bottle cap and the bottle top while the first fulcrum edge (135) is in contact the bottle cap disk shaped top section (45) at the first position; and, an engaging surface (165) oriented to engage the inside surface of the annular lip section (50).

11. The bottle cap opener of claim 10 wherein the engaging surface (165) is formed with a radius (150) contiguous therewith for forcibly engaging the bottle cap annular lip section (50) within the radius (150) as the bottle cap opener (100) is rotated about the first fulcrum edge (135) from a first starting position toward a second seal breaking position to thereby prevent the pry element from slipping off of the bottle cap.

12. The bottle cap opener of claim 9 wherein the first radial distance (G) is substantially 50.0 mm (1.97 inches) the second radial distance ($D_S$) is substantially 14.0 mm (0.55 inches), the third radial distance (H) is substantially 57.0 mm, (2.24 inches) and the fourth radial distance ($D_L$) is substantially 20.0 mm (0.79 inches).

13. The bottle cap opener of claim 12 wherein the shape of the handle portion is formed to provide common edges between adjacent elements in a nesting layout so that the opener (100) can be manufactured using reduced cutting time and material waste provided by a nested layout.

14. The bottle cap opener of claim 9 wherein the first fulcrum edge (135) and the second fulcrum edge (160) are separated by a leading surface (155) and wherein the leading surface (155) has a length dimension of substantially 6.1 mm (0.24 inches).

15. A method for opening a bottle cap with a bottle cap removing tool (100), the removing tool having a handle portion (105) and a nose portion (110), the nose portion being formed with a pry element (120) having a narrow leading edge (140) for fitting within an annular gap (60) formed between the bottle cap (40) and the bottle top (10), an engaging surface (165) for engaging the bottle cap at an inside surface of an annular lip section (50) of the bottle cap and a radius (150) formed at a base of the pry element 120, said nose portion further being formed with a first fulcrum edge (135), and a separate second fulcrum edge (160) comprising the steps of:

engaging the bottle cap removing tool in a first starting position with the engaging surface (165) in contact with the inside surface of the annular lip (50) and with the first fulcrum edge (135) in contact with the top section (45) at a first position;

rotating the bottle cap removing tool about the first fulcrum edge (135) to transfer a first pry force ($F_1$) to the pry element for deforming the annular lip (50) and continuing to rotate the bottle cap removal tool about the first fulcrum edge until the second fulcrum edge (160) is in contact with the bottle cap top section (45) at a second position;

rotating the bottle cap removing tool about the second fulcrum edge to transfer a second pry force ($F_2$) to the pry element until the bottle cap is removed from the bottle; and, wherein the step of rotating the bottle cap removal tool about the first fulcrum edge includes the step of forcibly engaging the bottle cap annular lip section (50) within the radius (150) for preventing the pry element from slipping off of the bottle cap.

16. The method of claim 15 wherein the first fulcrum edge (135) is formed at an intersection of a trailing surface (145) and a leading surface (155) and the second fulcrum edge (160) is formed at an intersection of the leading surface (155) and another surface and wherein the leading surface (155) makes an angle of 18° with the trailing surface (145) and wherein the step of rotating the bottle cap removing tool about the first fulcrum edge until the second fulcrum edge (160) is in contact with the bottle cap top section (45) at a second position comprises rotating the bottle opener (100) through an angle of 18°.

17. A method for removing a bottle cap (40) from a bottle top (10) using a unitary bottle cap removing tool (100) comprising the steps of:

engaging the bottle cap removing tool (100) with a bottle cap annular lip section (50) and with a first fulcrum edge (135) in contact with a bottle cap top section (45) at a first position;

applying a force (F) to a handle portion (105) of the bottle cap removing tool at a first end and in a direction for rotating the bottle cap removing tool about the first fulcrum edge (135) to deform the bottle cap annular lip section (50) with a first pry force ($F_1$) and continuing to apply the force (F) until a second fulcrum edge (165) makes contact with the bottle cap top section at a second position; and, continuing to apply the force (F) to the handle to thereby rotate the bottle cap opening tool about the second fulcrum edge (160) to remove the bottle cap from the bottle top with a second pry force ($F_2$), said second pry force being less than said first pry force ($F_1$).

18. The method of claim 17 wherein the unitary bottle cap removing tool (100) comprises a handle portion (105) and a nose portion (110), the nose portion being formed with a pry element (120) having a narrow leading edge (140) for fitting within an annular gap (60) formed between a bottle cap (40) and the bottle top (10), an engaging surface (165) for engaging the bottle cap at an inside surface of a bottle cap annular lip section (50), and a radius (150) formed at the base of the pry element 120, said nose portion further being formed with a first fulcrum edge (135), and a separate second fulcrum edge (160) and wherein the step of rotating the bottle cap removing tool about the first fulcrum edge further comprises the step of forcibly engaging the bottle cap annular lip section (50) within the radius (150) for preventing the pry element from slipping off of the bottle cap.

* * * * *